US010681483B2

(12) United States Patent
Imai

(10) Patent No.: US 10,681,483 B2
(45) Date of Patent: Jun. 9, 2020

(54) SOUND PROCESSING APPARATUS AND METHOD

(71) Applicant: Yamaha Corporation, Hamamatsu-shi, Shizuoka-Ken (JP)

(72) Inventor: Arata Imai, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 16/385,254

(22) Filed: Apr. 16, 2019

(65) Prior Publication Data

US 2019/0246227 A1 Aug. 8, 2019

Related U.S. Application Data

(63) Continuation of application No. PCT/JP2017/037217, filed on Oct. 13, 2017.

(30) Foreign Application Priority Data

Oct. 17, 2016 (JP) ..... 2016-203717

(51) Int. Cl.

| | |
|---|---|
| ***H04S 7/00*** | (2006.01) |
| ***H04R 3/12*** | (2006.01) |
| ***H04R 3/00*** | (2006.01) |

(52) U.S. Cl.

CPC ..... *H04S 7/30* (2013.01); *H04R 3/00* (2013.01); *H04R 3/12* (2013.01); *H04S 7/00* (2013.01); *H04R 2430/01* (2013.01)

(58) Field of Classification Search

CPC .... H04S 7/30; H04S 7/00; H04R 3/00; H04R 3/12; H04R 2430/01

See application file for complete search history.

(56) References Cited

U.S. PATENT DOCUMENTS

2015/0254055 A1 9/2015 Okabayashi et al.

FOREIGN PATENT DOCUMENTS

JP 2007-53631 A 3/2007
JP 2015-171001 A 9/2015

OTHER PUBLICATIONS

English machine translation of JP 2007-053631 (Kotaro et al., Digital Mixer, published Mar. 2007) (Year: 2007).*

(Continued)

*Primary Examiner* — Mark Fischer

(74) *Attorney, Agent, or Firm* — Crowell & Moring LLP

(57) ABSTRACT

A sound processing apparatus includes a signal processing device that individually performs first localization setting (e.g., sound volume panning) for setting localization of an input sound signal based on a value of a first parameter and second localization setting (e.g., delay panning) for setting localization of the input sound signal based on a value of a second parameter. In response to an adjustment by an operation device of the value of one of the first and second parameters, a control device automatically changes the value of the other of the first and second parameters. In this way, sound image localization based on the first localization setting and sound image localization based on the second localization setting are automatically controlled in an interlocked relation to each other. At least one of the sound signals localized based on the first and/or second localization setting is output to an output destination.

16 Claims, 3 Drawing Sheets

(56) References Cited

OTHER PUBLICATIONS

International Search Report (PCT/ISA/210) issued in PCT Application No. PCT/JP2017/037217 dated Dec. 12, 2017 with English translation (two (2) pages).
Japanese-language Written Opinion (PCT/ISA/237) issued in PCT Application No. PCT/JP2017/037217 dated Dec. 12, 2017 (four (4) pages).
Yamaha, "Digital Mixing Console LS9 LS9-16/LS9-32 Owner's Manual", (209 pages).
International Preliminary Report on Patentability (PCT/IB/338 & PCT/IB/373) issued in PCT Application No. PCT/JP2017/037217 dated May 2, 2019, including English translation of document C2 (Japanese-language Written Opinion (PCT/ISA/237) previously filed on Apr. 16, 2019) (nine (9) pages).

* cited by examiner

SOUND PROCESSING APPARATUS AND METHOD

PRIORITY

This application is based on, and claims priority to, JP PA 2016-203717 filed on 17 Oct. 2016 and International Patent Application No. PCT/JP2017/037217 filed on 13 Oct. 2017. The disclosure of the priority applications, in its entirety, including the drawings, claims, and the specification thereof, are incorporated herein by reference.

BACKGROUND

The embodiments of the present invention generally relate to a sound processing apparatus and method suitable for use, for example, in an audio mixer, and more particularly relate to a technique for setting localization of a sound signal.

Existing audio mixers (hereinafter also referred to simply as "mixers") installed in concert venues etc. are generally constructed in such a manner that, in each of a plurality of channels, sound volume of an input sound signal is adjusted via a fader of the channel and such a volume-adjusted sound signal is output to a bus. Then, in the bus, sound signals supplied from one or more of the channels are mixed, and the mixed result is output to an output destination, such as a main speaker or a monitor speaker.

Generally, the existing mixers include a "pan" module as a processing module for setting localization (panning) of sound signals of a plurality of channels, such as two-channel stereo signals or multi-channel surround signals. Among the existing pan modules is one that sets localization of sound signals by adjusting a sound volume difference between a plurality of channels. In this disclosure, such a pan module that sets localization of sound signals by adjusting a sound volume difference between a plurality of channels will be referred to as "sound volume pan module".

As methods for setting localization (panning), it has heretofore been known to set localization on the basis of a time difference (delay amount) between a plurality of channels, in addition to the aforementioned sound volume panning. In this disclosure, such panning based on a time difference (delay amount) between a plurality of channels will hereinafter be referred to as "delay panning".

SUMMARY

Use of the sound volume pan module (sound volume panning), however, may sometimes lead to reduction in a range ("service area") within which sound signals are deliverable. When localization is set in a large-scale concert venue such that the localization appears fully in one channel side of main speakers, the service area may decrease with no sound signal reaching an audience near the other channel side. If the service area decreases due to the use of the sound volume pan module as above, there would arise, among others, an inconvenience of a sound signal being heard differently depending on positions of audience seats. To avoid such inconveniences, in a large-scale concert venue, the sound volume pan module (sound volume panning) is sometimes not used, and sound signals for main speakers for the audience seats are mixed monaurally.

On the other hand, the delay panning achieves a wider service area than the sound volume panning. Thus, in some cases, a user may want to selectively use both the sound volume panning and the delay panning, for example, depending on respective environments of output destinations of sound signals. In such cases, it would be very convenient if setting of the sound volume panning and setting of the delay panning are associated with each other, for example, if the sound volume panning and the delay panning are both configured to set same localization. However, with the conventionally known mixers, it has been impossible to easily perform setting of the sound volume panning and setting of the delay panning in association with each other.

In view of the foregoing prior art problems, it is one of the objects of the present invention to provide a sound processing apparatus and method which enable a first parameter and a second parameter, which are used for localizing a sound signal, to be easily associated with each other with no extra time and labor required.

In order to accomplish the aforementioned objects, the inventive sound processing apparatus includes: a signal processing device configured to individually perform first localization setting for setting localization of an input sound signal based on a value of a first parameter and second localization setting for setting localization of the input sound signal based on a value of a second parameter different from the first parameter; an operation device operable by a user for adjusting the value of the first parameter or the second parameter; a control device that, in response to an adjustment by the operation device of the value of one of the first parameter and the second parameter, automatically changes the value of the other of the first parameter and the second parameter; and an output device that outputs at least one of the sound signal localized in accordance with the first localization setting and the sound signal localized in accordance with the second localization setting.

According to the inventive sound processing apparatus, the value of the first parameter for the first localization setting and the value of the second parameter for the second localization setting can be interlocked with each other, by automatically changing, in response to an adjustment of the value of one of the first parameter and the second parameter, the value of the other of the first parameter and the second parameter. Namely, a change of the value of one of the first and second parameters can be automatically reflected in the value of the other of the first and second parameters. Thus, according to the inventive sound processing apparatus, the value of the first parameter for the first localization setting and the value of the second parameter for the second localization setting can be automatically interlocked with each other, which thereby achieves the superior advantageous benefit that the first and second parameters to be used for localizing the sound signal can be associated with each other easily with no extra time and labor required.

In an embodiment, the first parameter is a parameter for setting localization based on a sound volume difference between a plurality of channels, and the second parameter is a parameter for setting localization based on a time difference in sound signal between the plurality of channels.

The disclosure made herein also embraces a sound processing method that includes steps corresponding to the constituent elements of the inventive sound processing apparatus set forth above. Also disclosed herein is a computer-readable, non-transitory storage medium storing a group of instructions executable by one or more processors for performing the aforementioned sound processing method.

BRIEF DESCRIPTION OF DRAWINGS

Certain embodiments of the present invention will hereinafter be described in detail, by way of example only, with reference to the accompanying drawings, in which.

DETAILED DESCRIPTION

Figure 1:
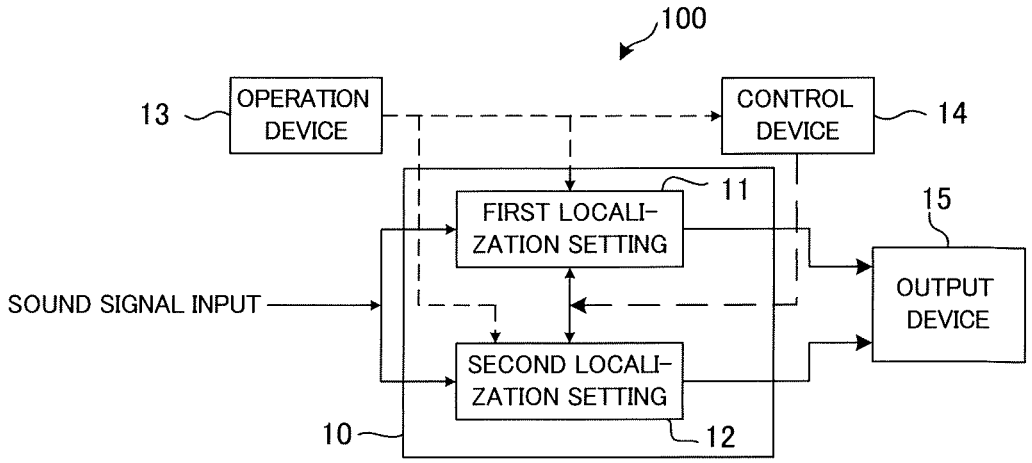
FIG. 1 is a block diagram illustrating an example construction of an inventive sound processing apparatus.

FIG. 1 is a block diagram explanatory of an example construction of an inventive sound processing apparatus 100. In FIG. 1, the inventive sound processing apparatus 100 includes: a signal processing device 10 configured to individually perform first localization setting for setting localization (sound image localization) of an input sound signal on the basis of a value of a first parameter and second localization setting for setting localization (sound image localization) of the input sound signal on the basis of a value of a second parameter that is different from the first parameter; an operation device 13 operable by a user to adjust the value of the first parameter or the value of the second parameter; a control device 14 that, in response to an adjustment by the operation device 13 of the value of one of the first and second parameters, automatically changes the value of the other of the first and second parameters; and an output device 15 that outputs at least one of the sound signal localized in accordance with the first localization setting and the sound signal localized in accordance with the second localization setting. In the signal processing device 10, a process for the first localization setting is performed by a first localization setting section 11, and a process for the second localization setting is performed by a second localization setting section 12.

The sound processing apparatus 100 of FIG. 1 is applicable to acoustic equipment, such as an audio mixer, that handles audio or sound signals. The following embodiments will be described in relation to an example where the inventive sound processing apparatus 100 is applied to an audio mixer (hereinafter referred to simply as "mixer") 20. Let it be assumed here that the mixer 20 is a digital mixer that processes sound signals solely through digital signal processing.

Figure 2:
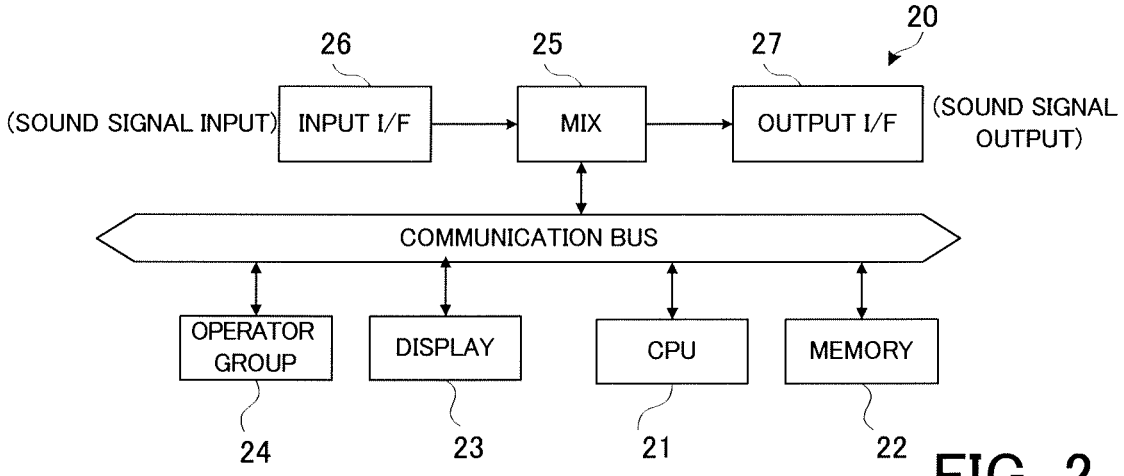
FIG. 2 is a block diagram illustrating an example electrical hardware construction of an audio mixer having the sound processing apparatus of FIG. 1 applied thereto.

FIG. 2 is a block diagram illustrating an example electrical hardware construction of the mixer 20. The mixer 20 includes a CPU (Central Processing Unit) 21, a memory 22, a display 23, an operator group 24, and a mixing section ("MIX" in the FIG. 25, and these components 21 to 25 are interconnected.

The CPU 21 controls overall behavior of the mixer 20 by executing various programs stored in the memory 22. The memory 22 not only non-volatilely stores various programs to be executed by the CPU 21, various data, etc., but also is used as a loading area for loading programs to be executed by the CPU 21 and as a working area. Processes (such as later-described processes of FIGS. 5 and 9) to be performed by the control device 14 of FIG. 1 are implemented by the CPU 21 executing the programs. The memory 22 may be constructed by combining, as necessary, various memory devices, such as a read-only memory, a random-access memory, a flash memory, and a hard disk.

The display 23 displays various information, based on display control signals given from the CPU 21, in various images, character strings, and the like. The operator group 24 includes a plurality of operators (manual operators) disposed on an operation panel of the mixer 20, related interface circuits, etc. More specifically, the operator group 24 includes a plurality of fader operators, rotary knob operators to be used for equalization, adjustment of panning, etc. The user of the mixer 20 uses the operator group 24 to execute various operations including setting of sound signal paths, adjustment of values of various parameters, etc. The CPU 21 acquires a detection signal corresponding to each input operation executed by the user on the operator group 24 and on the display 23 and controls the behavior of the mixer 20 on the basis of the acquired detection signal. One or more operators included in the operator group 24 correspond to the operation device 13 of FIG. 1.

The mixing section 25 performs various mixing processing (including, among others, sound volume control, pan control, effect process, and equalizer process) on input sound signals. Such a mixing section 25 is implemented, for example, by a DSP (Digital Signal Processor) operating in accordance with mixing processing microprograms, or by the CPU 21 executing a mixing processing software program stored in the memory 22. The mixing section 25 corresponds to the signal processing device 10 (first and second localization setting sections 11 and 12) of FIG. 1. By executing the mixing processing software program, the mixing section 25 processes one or more sound signals input from not-shown input equipment via an input interface (input I/F) 26 and outputs the thus-processed sound signals to not-shown output equipment (such as speakers) via an output interface (output I/F) 27.

Figure 3:
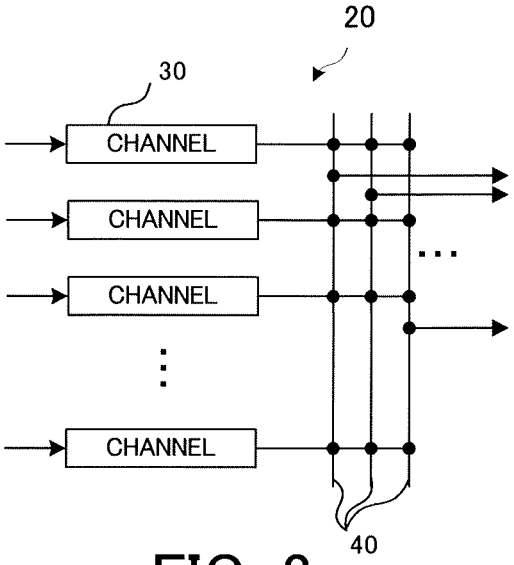
FIG. 3 is a block diagram explanatory of an example signal processing construction of the audio mixer of FIG. 2.

FIG. 3 is a block diagram illustrating an example construction of signal processing performed by the mixing section 25 of the mixer 20. The mixer 20 includes a plurality of channels 30 and a plurality of mixing buses 40. Each of the channels 30 performs various signal processing, including sound volume adjustment etc., on an input sound signal and supplies the processed sound signal to one or more of the mixing buses 40 selected by the user. Each of the mixing buses 40 mixes sound signals supplied from one or more of the channels 30. Each mixed sound signal output from each of the mixing buses 40 is processed by an output channel (not shown) corresponding to the mixing bus 40 and then output via a main speaker, monitor speaker or other output destination (not shown). The user of the mixer 20 uses the operator group 24 to adjust values of various parameters of the individual channels 30. In response to user's operations on the operator group 24, the CPU 21 changes the values of various parameters stored in the memory 22. The signal processing illustrated in FIG. 3 is controlled on the basis of the values of the parameters stored in the memory 22.

Figure 4:
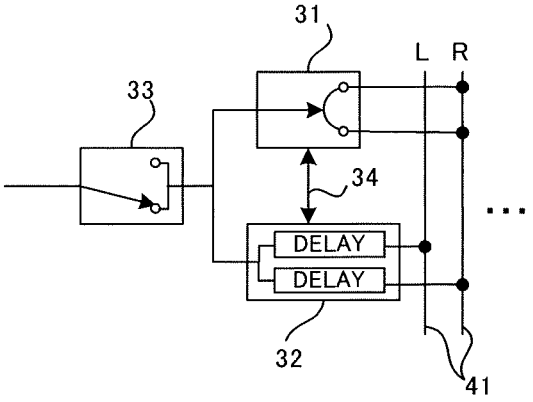
FIG. 4 is a diagram illustrating an example construction of a channel provided in the audio mixer of FIG. 2.

FIG. 4 illustrates an example of a detailed construction of one of the plurality of channels 30. As illustrated in FIG. 4, the channel 30 includes, as processing modules for setting localization (sound image localization) of a sound signal, a sound volume pan module 31 for localizing a sound signal on the basis of a sound volume difference between the channels, and a delay pan module 32 for localizing a sound signal on the basis of a time difference (delay amount) between the channels. The channel 30 is constructed or configured in such a manner that any one of the sound volume pan module 31 and the delay pan module 32 can be selected by a selection section 33. The selection section 33 is a selector that selects and outputs any one of the sound signal localized by the first localization setting section 11 (sound volume pan module 31) and the sound signal localized by the second localization setting section 12 (delay pan module 32).

The sound signal input to the channel 30 is subjected to characteristic control and sound volume adjustment (not shown) and then supplied to the sound volume pan module 31 or delay pan module 32 selected by the selection section 33. The selected sound volume pan module 31 or delay pan module 32 selected by the selection section 33 localizes the supplied sound signal in accordance with a value of a parameter and supplies the localized sound signals to stereo buses 41. The stereo buses 41, which are buses of a two-channel stereo configuration (composed of a pair of "L" and "R" buses), mix the supplied sound signals into two-channel stereo signals and output the mixed sound signals. The stereo buses 41 are included in the buses 40 of FIG. 3. The localized sound signals output via the stereo buses 41 are sent via the output interface 27 to output equipment, such as external speakers. The stereo buses 41 and the output interface 27 constitute an output device that corresponds to the output device 15 of FIG. 1 and that outputs at least one of the sound signal localized in accordance with the above-mentioned first localization setting and the sound signal localized in accordance with the above-mentioned second localization setting. More specifically, the stereo buses 41 and the output interface 27 output the sound signal selected by the selection section (selector) 33.

As well known in the art, the sound volume pan module 31 is designed to create a sound volume difference between two or more channels such that a sound is heard with localization biased (or offset) toward a channel having a larger sound volume. The sound volume pan module 31 localizes a sound signal on the basis of a setting value of a parameter that prescribes a sound volume difference between two channels corresponding to the stereo buses 41 (such a setting value will hereinafter be referred to as "setting value of the sound volume pan module 31"). As also well known, the delay pan module 32 uses the human's auditory characteristic that a sound is heard with localization biased (offset) toward a channel where a sound is heard earlier than another sound (Haas effect or precedence effect). The delay pan module 32 localizes a sound signal on the basis of a setting value of a parameter that prescribes a time difference (delay amount) between the two channels corresponding to the stereo buses 41 (such a setting value will hereinafter be referred to as "setting value of the delay pan module 32"). One feature of the mixer 20 resides in that the mixer 20 interlocks the setting value of the sound volume pan module 31 and the setting value of the delay pan module 32 with each other (as depicted by arrow 34 in FIG. 4). Namely, in the illustrated example of FIG. 4, the sound volume pan module 31 corresponds to the first localization section 11 of FIG. 1, and the setting value of the sound volume pan module 31 corresponds to the value of the first parameter. The delay pan module 32 corresponds to the second localization section 12 of FIG. 1, and the setting value of the delay pan module 32 corresponds to the value of the second parameter.

As also well known in the art, the term "sound signal localization" represents a position (angle) of a virtual sound source relative to a listener in a two-channel stereo or multi-channel surround environment. For example, when the localization is set at a center position of a sound field, the listener feels as if the sound source were located at the center position of the sound field, namely, as if the sound signal were heard (sounded) from the center position. When the localization is set biased leftward from the center position of the sound field, the listener feels as if the sound source were located leftward of the center position, namely, as if the sound signal were heard (sounded) from a left side of the sound field. In this disclosure, the terms "left" and "right" represent "left" and "right" of the two-channel stereo configuration.

Figure 5:
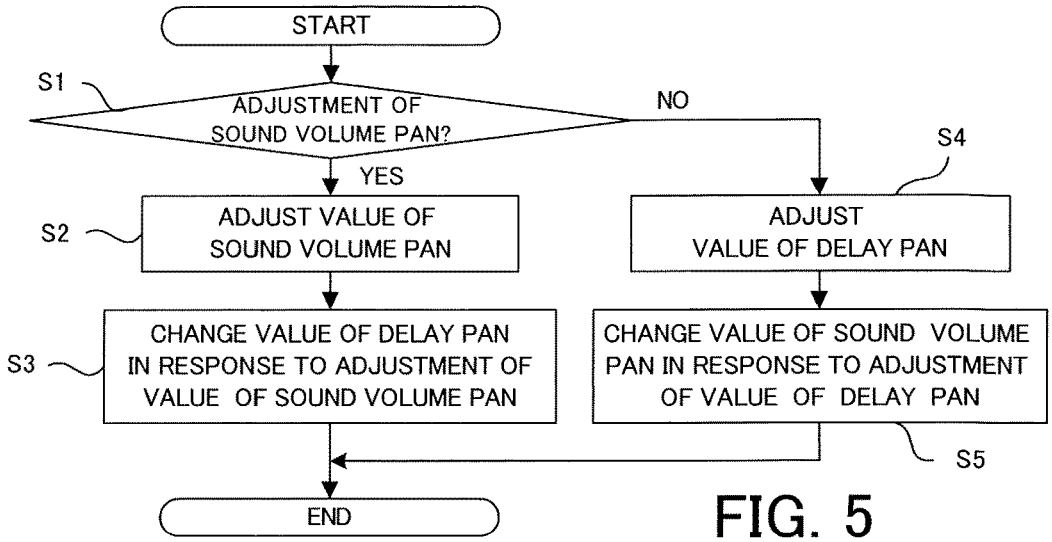
FIG. 5 is a flow chart illustrating an example of a process responsive to a value adjusting operation.

FIG. 5 is a flow chart illustrating an example of a process responsive to an operation for adjusting the setting value of the sound volume pan module 31 or the setting value of the delay pan module 32 (namely, adjusting a localization controlling parameter). The process of FIG. 5 is started in response to a user's operation for adjusting the setting value of the sound volume pan module 31 or the setting value of the delay pan module 32. The setting value adjusting operation can be executed by the user operating one or more physical switches included in the operator group 24 of FIG. 2 corresponding to the operation device 13 of FIG. 1 or one or more operator icons displayed on the display 23. Such localization controlling parameter adjustment may be executed by an automatic operation based on control data or the like, rather than by the user's operation on the operation device 13 or operator group 24, or the operator icons.

Once the operation (user's operation or automatic operation) for adjusting the setting value of the sound volume pan module 31 is executed (YES determination at step S1), the CPU 21 adjusts, in response to the operation, the setting value of the sound volume pan module 31 of the channel 30 stored in the memory 22 (step S2). Then, in response to the adjustment of the setting value of the sound volume pan module 31, the CPU 21 automatically changes the setting value of the delay pan module 32 of the channel 30 stored in the memory 22 (step S3).

Once the operation (user's operation or automatic operation) for adjusting the setting value of the delay pan module 32 is executed (NO determination at step S1), the CPU 21 adjusts, in response to the operation, the setting value of the delay pan module 32 of the channel 30 stored in the memory 22 (step S4). Then, the CPU 21 automatically changes, in response to the adjustment of the setting value of the delay pan module 32, the setting value of the sound volume pan module 31 of the channel 30 stored in the memory 22 (step S5).

As an example, the CPU 21 performs the aforementioned operations of steps S3 and S5 according to a criterion prescribing association between the value of the parameter for the sound volume pan module 31 (sound volume panning parameter (namely, first parameter)) and the value of the parameter for the delay pan module delay (delay panning parameter (namely, second parameter)). More specifically, the aforementioned criterion is stored in a data table (hereinafter referred to as "associating table") where a plurality of values the sound volume panning parameter can take and a plurality of values the delay panning parameter can take are associated with each other, and the operations of steps S3 and S5 are performed on the basis of the associating table. For example, the associating table is retained in the memory 22. In this case, at step S3 above, the CPU 21 acquires, on the basis of the associating table, a setting value of the delay pan module 32 that corresponds to the setting value of the sound volume pan module 31 changed at step S2 above and then changes (or replaces) the setting value of the delay pan module 32 of the channel 30 stored in the memory 22 to (or with) the acquired setting value. Further, at step S5 above, the CPU 21 acquires, on the basis of the associating table, a setting value of the sound volume pan module 31 that corresponds to the setting value of the delay pan module 32 changed at step S4 above and then changes the setting value of the sound volume pan module 31 of the channel 30 stored in the memory 22 to the acquired setting value.

Figure 6:
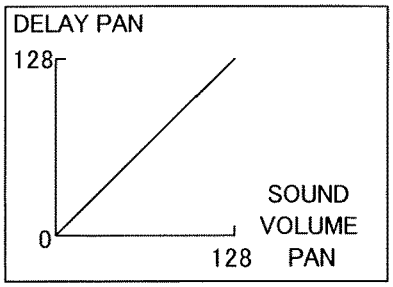
FIG. 6 is a diagram illustrating an example of an associating table.

FIG. 6 illustrates an example of the above-mentioned associating table, in which the plurality of values the sound volume panning parameter can take are represented on the horizontal axis while the plurality of values the delay panning parameter can take are represented on the vertical axis. In the illustrated example of FIG. 6, the values of the sound volume panning parameter and the values of the delay panning parameter are represented in same resolution (for example, in 128 steps of values), and it is assumed that a same value of the sound volume panning parameter and delay panning parameter represents same localization. For example, a minimum value "0" of each of the sound volume panning and delay pan panning represents a right end, a central value "64" each of the sound volume panning and delay panning represents a center, and a maximum value "128" each of the sound volume panning and delay panning represents a left end. The associating table of FIG. 6 associates the individual values "0" to "128" of the sound volume pan module 31 and the individual values "0" to "128" of the delay pan module 32 with each other in a linear manner.

Thus, according to the associating table of FIG. 6, the parameter values for the sound volume pan module (sound volume panning parameter values) and the parameter values for the delay pan module (delay panning parameter values) are associated with each other in such a manner that the sound volume pan module and the delay pan module provide same (or common) localization. For example, when the sound volume panning parameter value represents localization biased rightward by 30 degrees from the center position, the delay panning parameter value corresponding to the sound volume panning parameter value is also set, in accordance with the associating table, at a value representing localization biased rightward by 30 degrees from the center position. Thus, according to the associating table of FIG. 6, in response to the parameter value of only one of the sound volume pan module 31 and delay pan module 32 being adjusted, the parameter values of both of the sound volume pan module 31 and delay pan module 32 are automatically set in such a manner that the sound volume pan module 31 and the delay pan module 32 provide same localization.

By the operations of steps S3 and S5 illustrated in FIG. 5, the CPU 21 can reflect the change of the setting value of one of the sound volume pan module 31 and delay pan module 32 in the setting value of the other of the sound volume pan module 31 and delay pan module 32. Namely, the CPU 21 can interlock the setting value of the sound volume pan module 31 and the setting value of the delay pan module 32 with each other. Thus, the sound volume panning parameter setting and the delay panning parameter setting can be automatically associated (correlated) with each other.

In FIG. 5, the aforementioned operation of step S2 is an operation for adjusting the value of the first parameter (sound volume panning parameter) via the operation device 15, and the aforementioned operation of step S4 is an operation for adjusting the value of the second parameter (delay panning parameter) via the operation device 15. Thus, the operations of steps S3 and S5 performed by the CPU 21 following steps S2 and S4, respectively, correspond to the control performed by the control device 14 of FIG. 1. Namely, the construction where the operations of steps S3 and S5 are performed by the CPU 21 corresponds to the control device 14 that, in response to an adjustment by the operation device 13 of the value of one of the first parameter (sound volume panning parameter) and the second parameter (delay panning parameter), automatically changes the value of the other of the first parameter and second parameter.

Figure 7:
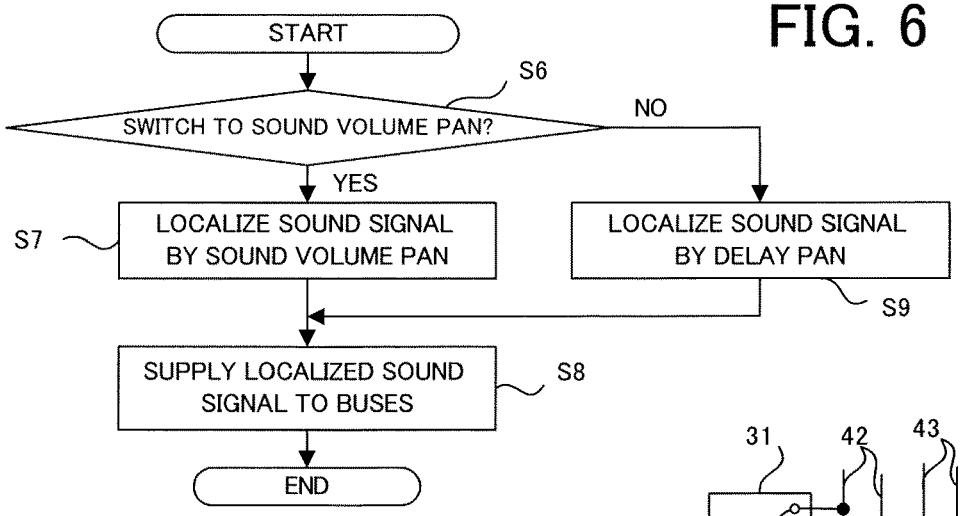
FIG. 7 is a flow chart illustrating an example of a process for switching between localization setting methods.

FIG. 7 is a flow chart illustrating an example of a process for switching between localization setting methods. Once the user instructs switching one of the sound volume pan module 31 and delay pan module 32, currently selected by the selection section 33, to the other of the sound volume pan module 31 and delay pan module 32, the CPU 21 starts the process of FIG. 7. Such a localization-setting-method switching instruction can be given by the user selecting any one of the sound volume pan module 31 and delay pan module 32, for example, by use of a physical instructing switch included in the operator group 24 or an instructing switch icon displayed on the display 23.

Once the sound volume pan module 31 is selected (YES determination at step S6), the CPU 21 switches the signal path of the channel 30 in question such that an input sound signal is supplied to the sound volume pan module 31 of the channel 30 (step S7). Thus, the sound signal localized by the sound volume pan 31 is supplied to the stereo buses 41, so that a mixed result including the signal localized by the sound volume pan 31 is output from each of the stereo buses 41 (step S8). Once the delay pan module 32 is selected (NO determination at step S6), on the other hand, the CPU 21 switches the signal path of the channel 30 such that an input sound signal is supplied to the delay pan module 32 (step S9). Thus, the signal localized by the delay pan 32 is supplied to the stereo buses 41, so that the mixed result including the signal localized by the delay pan 32 is output from each of the stereo buses 41 (step S8).

Because the setting value of the sound volume pan module 31 and the setting value of the delay pan module 32 are set and adjusted in an automatically interlocked manner as set forth above, the localization of a sound based on the sound signal output at step S8 from of the stereo buses 41 as a result of the localizing process by the one of the pan modules 31 or 32 immediately before the switching and the localization of the sound signal output at step S8 from the stereo buses 41 as a result of the localizing process by the other of the pan modules 32 or 31 immediately after the switching are associated with each other (for example, the same localization is provided immediately before and immediately after the switching). Thus, by merely switching between the instructing switches of the selection section 33, the user can easily interchangeably use the sound volume pan module 31 and the delay pan module 32 without having to perform the localization setting again after the switching. For example, the user can easily selectively use any desired one of the sound volume pan module 31 and delay pan module 32 after listening to and comparing sounds localized by the sound volume pan module 31 and by the delay pan module 32. Specifically, the user can easily selectively use any desired one of the sound volume pan module 31 and delay pan module 32 depending on the time and situation; for example, at a preparation stage of mixer setting in a concert, the user may set localization of the sound signal by using the sound volume pan module 31 that is more familiar to the user, and at an actual stage of the concert, the user may set localization of the sound signal by using the delay pan module 32 that has a wider service area.

The example of FIG. 5 has been described as performing the operation (of step S3 or S5) for interlocking the setting value of the sound volume pan module 31 and the setting value of the delay pan module 32 with each other in response to a value adjusting operation. As a modification, the interlocking operation (of step S3 or S5) may be performed in response to a localization-setting-method switching operation. In such a case, once an operation is executed for adjusting the setting value of the sound volume pan module 31 or delay pan module 32 currently selected in any one of the channels 30, the CPU 21 only adjusts the setting value of the currently selected sound volume pan module 31 or delay pan module 32 (step S2 or S4). Then, in response to a localization-setting-method switching operation, the CPU 21 changes, in accordance with the setting value of the currently selected sound volume pan module 31 or delay pan module 32 stored in the memory 22, the setting value of the other of the sound volume pan module 31 or delay pan module 32 stored in the memory 22 (modification of step S3 or S5 above) and switches between the instructing switches of the selection section 33 (step S7 or S9).

Figure 8:
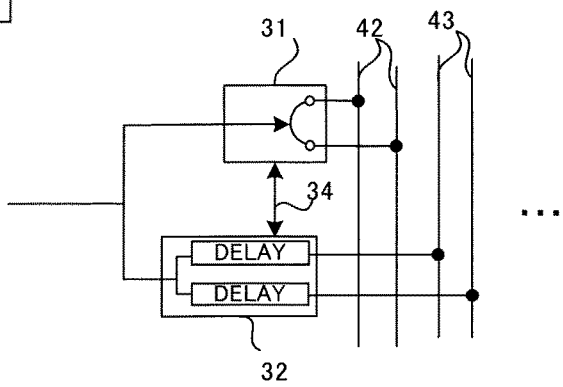
FIG. 8 is a diagram illustrating another example of the construction of the channel.

Further, FIG. 8 illustrates another example of the construction of the channel 30. As illustrated in FIG. 8, the channel 30 includes the sound volume pan module 31 and the delay pan module 32, but does not include the selection section 33 illustrated in FIG. 4. In the illustrated example of FIG. 8, first buses 42 corresponding to the sound volume pan module 31 and second buses 43 corresponding to the delay pan module 32 are provided separately in the mixing buses 40. In this construction of FIG. 8, a same sound signal input to the channel 30 is supplied to both of the sound volume pan module 31 and delay pan module 32. Then, the sound signal localized by the sound volume pan module 31 is supplied to the first buses 42, and the sound signal localized by the delay pan module 32 is supplied to the second buses 43. Thus, the sound signal localized by the sound volume pan module 31 and the sound signal localized by the delay pan module 32 are output separately via the respective buses 42 and 43. In this case too, the setting value of the sound volume pan module 31 and the setting value of the delay pan module 32 are automatically adjusted so as to interlock with each other (as depicted by arrow 34 in FIG. 8).

As an example, the first buses 42 and the second buses 43 have different uses. Namely, environments of destinations (sound signal transmission or output destinations), to which sound signals are transmitted via the first and second buses 42 and 43, differ from each other. For example, the first buses 42 are monitor output buses for monitor output to a human player or human players on a stage of a concert venue, while the second buses 43 are stereo buses for main output to audience seats of the concert venue.

The main output to the audience seats has a wider service area than the monitor output. Particularly, in a huge concert venue, such as a stadium, the main output has an extremely wide service area. By contrast, the monitor output is used for the monitor speakers on the stage, human players' in-ear monitors, etc., and thus has a narrower service area than the main output. The localization control based on the sound volume pan module 31 has the disadvantage that it is not be suitable for use in a vast service area, such as a huge concert venue, because there may occur an area which a sound does not reach when localization is set fully to any one of left and right speakers (or to any one of left and right limits in the localization control); in other words, the service area may narrow due to the use of the sound volume pan module 31. In view of such a disadvantage, the construction of FIG. 8 is arranged to enable the sound volume pan module 31 and delay pan module 32 to be used selectively in accordance with the respective uses (monitor output use and main output use) of the first and second buses 42 and 43. Thus, the user can use an appropriate localization setting method suiting the environment of each sound signal transmission or output destination.

Figure 9:
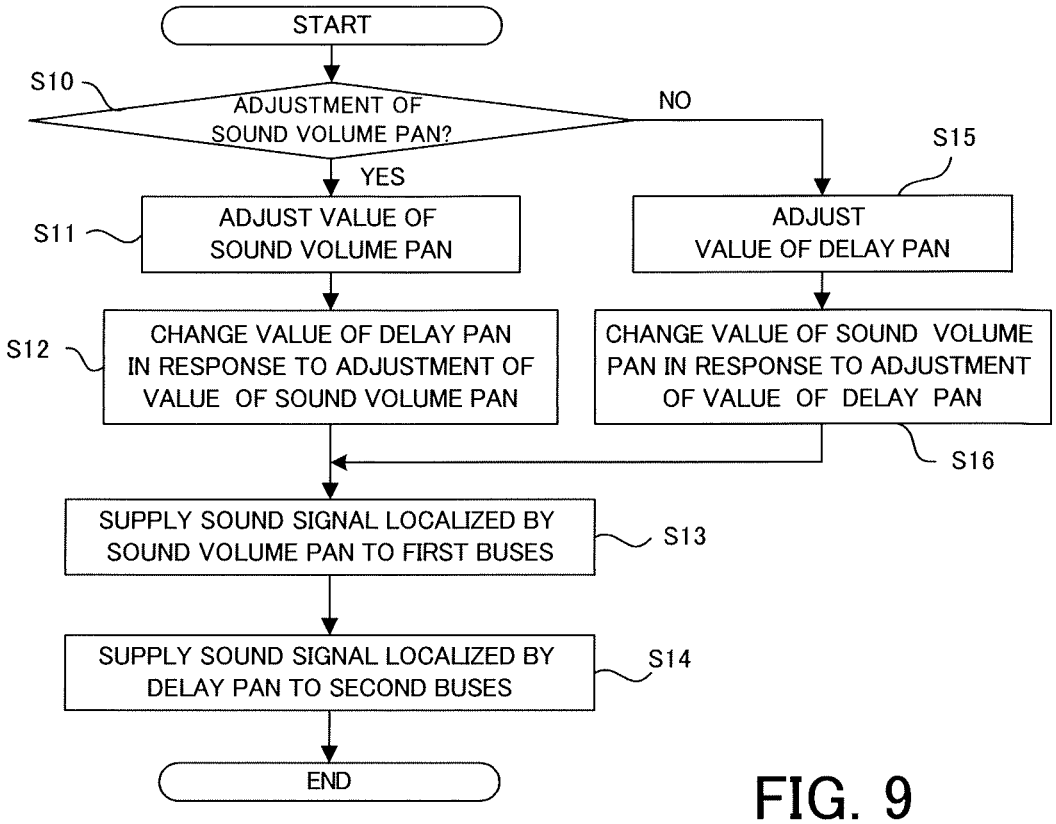
FIG. 9 is a flow chart illustrating another example of the process responsive to a value adjusting operation.

FIG. 9 shows a process performed by the CPU 21 in response to an operation for adjusting the setting value of the sound volume pan module 31 or the setting value of the delay pan module 32 in the channel construction illustrated in FIG. 8. Once an operation is executed for adjusting the setting value of the sound volume pan module 31 of any one of the channels 30 (YES determination at step S10), the CPU 21 adjusts, in response to the adjusting operation, the setting value of the sound volume pan module 31 stored in the memory 22 (step S11). Then, in accordance with the adjusted setting value of the sound volume pan module 31 (and on the basis of the associating table of FIG. 6, for example), the CPU 21 automatically changes the setting value of the delay pan module 32 of the channel stored in the memory 22 (step S12).

Further, once an operation is executed for adjusting the setting value of the delay pan module 32 of any one of the channels 30 (NO determination at step S10), the CPU 21 adjusts, in response to the adjusting operation, the setting value of the delay pan module 32 stored in the memory 22 (step S15). Then, in accordance with the adjusted setting value of the delay pan module 32 (and on the basis of the associating table of FIG. 6, for example), the CPU 21 automatically changes the setting value of the sound volume pan module 31 of the channel stored in the memory 22 (step S16).

Then, the sound signal localized by the sound volume pan module 31 is supplied to the first buses 42, so that a mixed result including the sound signal localized by the sound volume pan module 31 is output via the first buses 42 (step S13). Further, the sound signal localized by the delay pan module 32 is supplied to the second buses 43, so that mixed result including the sound signal localized by the delay pan module 32 is output via the second buses 43 (step S14).

Thus, by steps S12 and S16 of FIG. 9, the CPU 21 can reflect the adjustment/change of the setting value of any one of the sound volume pan module 31 and delay pan module 32 in the setting value of the other of the sound volume pan module 31 and delay pan module 32. Namely, the CPU 21 can interlock the setting value of the sound volume pan module 31 and the setting value of the delay pan module 32 with each other. In this way, the setting value of the sound volume pan module 31 and the setting value of the delay pan module 32 can be associated (correlated) with each other easily with no extra time and labor required.

In the case where the setting value of the sound volume pan module 31 and the setting value of the delay pan module 32 are interlocked with each other at steps S12 and S16 as noted above, the user of the mixer 20 can easily set same localization, with no extra time and labor required, with respect to each of the environments of the sound signal transmission destinations of the first and second buses 42 and 43, by merely adjusting any one of the setting value of the sound volume pan module 31 and the setting value of the delay pan module 32. For example, by merely adjusting the setting value of the sound volume pan module 31 while listening to monitor output sounds output via the first buses 42, the user of the mixer 20 can set a main output sound output via the second bus 43 (setting value of the delay pan module 32) to the same localization as a monitor output sound. Thus, in each of the environments of the sound signal transmission destinations of the first and second buses 42 and 43, appropriate localization as desired by the user, which gives no uncomfortable and strange feeling, can be set. Further, even in the construction where the sound volume pan module 31 and the delay pan module 32 are selectively used for the first buses 42 and the second buses 43, respectively, no extra time and labor is required because the setting values of both of the sound volume pan module 31 and delay pan module 32 can be set by the user merely adjusting the setting value of any one of the sound volume pan module 31 and delay pan module 32.

Further, in FIG. 9, the operations of steps S12 and S16 performed by the CPU 21 following steps S11 and S15, respectively, correspond to the control performed by the control device 14 of FIG. 1. Namely, the construction where the operations of steps S12 and S16 are performed by the CPU 21 corresponds to the control device 14 that, in response to an adjustment by the operation device 13 of the value of any one of the first parameter (sound volume panning parameter) and second parameter (delay panning parameter), automatically changes the value of the other of the first and second parameters. Further, the first buses 42, second buses 43, and output interface 27 constitute the output device that corresponds to the output device 15 of FIG. 1, and that outputs at least one of the sound signal localized in accordance with the above-mentioned first localization setting and the sound signal localized in accordance with the above-mentioned second localization setting. More specifically, the first buses 42, second buses 43 and output interface 27 output the sound signal localized in accordance with the first localization setting and the sound signal localized in accordance with the second localization setting.

Figure 10:
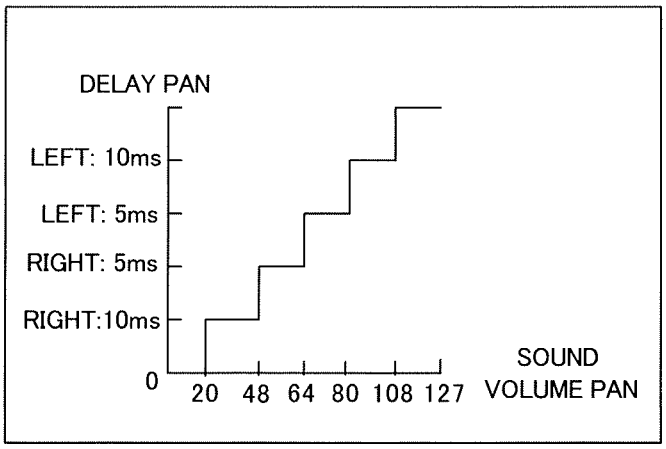
FIG. 10 is a diagram illustrating another example of the associating table.

In another embodiment, the aforementioned criterion (namely, the aforementioned associating table) used at steps S3, S5, S12, and S16 above may be one that associates the setting value of the sound volume pan module 31 and the setting value of the delay pan module 32 in a stepwise manner. FIG. 10 illustrates an example construction of an associating table in which a plurality of values the sound volume panning parameter can take and a plurality of values the delay panning parameter can take are associated with each other in a stepwise manner. In FIG. 10, the plurality of values the sound volume panning parameter can take are represented on the horizontal axis, while the plurality of values the delay panning parameter can take are represented on the vertical axis. The sound volume panning parameter and the delay panning parameter are each represented in 128 steps of values (namely, values 0 to 127), of which each same value represents same localization. Note that in FIG. 10, the values of the delay panning parameter are each represented in milliseconds ("ms") for convenience. In the associating table of FIG. 10, value "20" of the sound volume panning parameter is associated with a value range of the delay panning parameter indicating that the right channel is delayed relative to the left channel by 10 ms or more, value "48" of the sound volume panning parameter is associated with a value range of the delay panning parameter indicating that the right channel is delayed relative to the left channel by 5 ms or more but less than 10 ms, value "64" (indicative of the center position) of the sound volume panning parameter is associated with a value range of the delay panning parameter from a range portion indicating that the right channel is delayed relative to the left channel by less than 5 ms to a range portion indicating that the left channel is delayed relative to the right channel by less than 5 ms, value "80" of the sound volume panning parameter is associated with a value range of the delay panning parameter indicating that the left channel is delayed relative to the right channel by 5 ms or more but less than 10 ms, and value "108" of the sound volume panning parameter is associated with a value range of the delay panning parameter indicating that the left channel is delayed relative to the right channel by 10 ms or more. On the other hand, value "0" (indicative of localization at the extreme right end) of the delay panning parameter is associated with a value range of the sound volume panning parameter less than 20, a value of the delay panning parameter indicating that the right channel is delayed relative to the left channel by 10 ms is associated with a value range of the sound volume panning parameter of 20 or more but less than 48, a value of the delay panning parameter indicating that the right channel is delayed relative to the left channel by 5 ms is associated with a value range of the sound volume panning parameter of 48 or more but less than 64, a value of the delay panning parameter indicating that the left channel is delayed relative to the right channel by 5 ms is associated with a value range of the sound volume panning parameter of 64 or more but less than 80, a value of the delay panning parameter indicating that the left channel is delayed relative to the right channel by 10 ms is associated with a value range of the sound volume panning parameter of 80 or more but less than 108, and value "127" (indicative of localization at the extreme left end) of the delay panning parameter is associated with a value range of the sound volume panning parameter of 108 and more. In the case where the associating table of FIG. 10 is used, too, it is possible to automatically change, in response to a change of the setting value of any one of the sound volume pan module 31 and delay pan module 32, the setting value of the other of the sound volume pan module 31 and delay pan module 32 in association with (in interlocked relation to) the change of the setting value of the one of the sound volume pan module 31 and delay pan module 32 (steps S3, S5, S12, and S16).

In still another embodiment, association between the setting value of the sound volume pan module 31 and the setting value of the delay pan module 32 may be determined, at steps S3, S5, S12, and S16, on the basis of calculated values of a time difference and volume difference of localized sound signals between the two ears of a listener when the listener listens to the sound signals. Such calculations may be executed, for example, on the basis of a distance between the two ears of the listener, a distance between a sound source and the listener, an angle formed between a "line connecting the two ears" and a "line connecting the sound source and the listener", etc. The time difference and volume difference are calculated, for example, per each virtual sound source position (localization position). For instance, an associating table prescribing the time difference and volume difference calculated per each virtual sound source position (localization position) is stored in the memory 22 of the mixer 20. At steps S3, S5, S12, and S16 above, the CPU 21 can acquire, on the basis of the associating table, the value of the sound volume pan module 31 or delay pan module 32 corresponding to the value of the delay pan module 32 or volume pan module 31. Namely, the aforementioned operations of steps S3, S5, S12, and S16 may be configured to automatically change, in accordance with the value of one of the sound volume panning parameter (first parameter) and delay panning parameter (second parameter) having been adjusted, the value of the other of the sound volume panning parameter and delay panning parameter on the basis of characteristics of the volume difference and time difference of the localized sound signal between the two ears of the listener.

In still another embodiment, the aforementioned criterion (the aforementioned associating table), namely, the association between the value of the sound volume panning parameter and the value of the delay panning parameter, which is used at steps S3, S5, S12, and S16 above, may be set in any manner as desired by the user. In this case, the user can associate the value of the sound volume panning parameter and the value of the delay panning parameter with each other freely in accordance with his or her preference etc. Further, the value of the sound volume panning parameter and the value of the delay panning parameter may be associated with each other in any desired manner as long as the localization setting of the sound volume panning and the localization setting of the delay panning are linked with each other, namely, as long as, in correlation to the value of one of the sound volume panning parameter and delay panning parameter, the value of the other of the sound volume panning parameter and delay panning parameter can be determined.

In still another embodiment, a plurality of types of associating tables may be prestored in the memory 22 so that the user can select any desired one of the associating tables. As an example, the memory 22 may prestore a plurality of types of associating tables corresponding to various conditions, such as a size, shape, etc. of a service area (more specifically, conditions, such as a type, space width, area, etc. of a building to be used as the service area). In such a case, the user can select an appropriate one of the associating tables depending on an environment etc. of an output destination of a sound signal. As one specific example of such associating tables corresponding to various conditions, such as a size, shape, etc. of a service area is conceivable an associating table for a large-scale hall that is arranged to narrow localizing swing widths (i.e., angles from the center position) of the sound volume panning to be associated with individual localizations of the delay panning, namely, that is arranged to not largely swing the localization in the sound volume panning even when a great time difference is set for the sound volume panning. As another example, the user may input conditions, such as a size, shape, etc. of a service area, in such a manner that association between the value of the sound volume panning parameter and the value of the delay panning parameter can be provided in accordance with the user-input conditions.

In yet still another embodiment, arrangements may be made such that any one of the sound volume panning (first localization setting) and delay panning (second localization setting) is automatically selected in accordance with an environment of an output destination of a sound signal. In such a case, once the user inputs an environment (for example, main output or monitor output environment) of the output destination of the sound signal, the CPU 21 performs the aforementioned process of FIG. 7 in accordance with the user-input environment. For example, the embodiment may be arranged in such a manner that the sound volume panning is automatically selected if the environment of the output destination is the monitor output.

Further, separate operators may be provided for adjusting the value of the sound volume panning parameter (parameter of the first localization setting) and for adjusting the value of the delay panning parameter (parameter of the second localization setting), or a common operator may be provided both for adjusting the value of the sound volume panning parameter and for adjusting the value of the delay panning parameter. Further, such a value adjusting operator may be provided separately for each of the channels 30, or a common value adjusting operator may be provided for the plurality of channels 30.

In the case where a common operator is used both for adjusting the setting value of the sound volume pan module 31 and for adjusting the setting value of the delay pan module 32 in the example channel construction of FIG. 4, the setting value of the sound volume pan module 31 or delay pan module 32 currently selected via the selection section 33 may be set as an object of adjustment that is to be made via the common operator. As another example, the user may designate, as an object of adjustment to be made via the common operator, any one of the sound volume pan module 31 and delay pan module 32, independently of the selection made by the selection section 33. Similarly, in the case where a common operator is used both for adjusting the setting value of the sound volume pan module 31 and for adjusting the setting value of the delay pan module 32 in the example channel construction of FIG. 8, the user may designate any one of the sound volume pan module 31 and delay pan module 32 as an object of adjustment to be made via the common operator.

Further, the operators for adjusting the setting values of the sound volume pan module 31 and delay pan module 32 may be in the form of operators dedicated for setting value adjustment of the sound volume pan module 31 and/or delay pan module 32, or in the form of general-purpose operators to which desired parameters are assignable as objects of operation.

Further, the operators for adjusting the setting values of the sound volume pan module 31 and delay pan module 32 may be image objects, such as operator images, displayed on the display 23, rather than being limited to physical operators.

In yet still another embodiment, the CPU 21 may change, on the basis of an operated amount corresponding to an operation for adjusting the setting value of any one of the sound volume pan module 31 and delay pan module 32, the setting value of the other of the sound volume pan module 31 and delay pan module 32, at steps S3, S5, S12, and S16. In yet still another embodiment, in response to an operation for setting localization of any one of the channels 30, the CPU 21 may perform control for changing both of the setting value of the sound volume pan module 31 (value of the first parameter in the first localization setting section 11) and the setting value of the delay pan module 32 (value of the second parameter in the second localization setting section 12) of that channel stored in the memory 22 (as modifications of steps S2 to S5, S11, S12, S15, and S16). Further, the operations for setting localization are, for example, operations of localization setting operators (operator group 24) provided on the operation panel, or operations on the screen of the display 23. In any of these cases, the user can set mutually associated values (for example, values for achieving same localization) in both of the sound volume pan module 31 and delay pan module 32, by merely executing a localization setting operation without paying any attention to a difference between the localization setting methods (namely, a difference between the sound volume panning and the delay panning).

Furthermore, the above-described embodiments of the present invention may be combined as desired. Moreover, although the embodiments of the present invention have been described above in relation to sound image localization control using a pair of left and right channels, the embodiments of the present invention are also applicable to twodimensional or three-dimensional sound image localization control using two or more channels.

It should be appreciated that the present invention is not limited to the above-described embodiments and various modifications of the present invention are of course possible within the scope of the technical ideas disclosed in the claims, description and drawings. For example, the inventive sound processing apparatus 100 may be applied to any other apparatus than the mixer 20, such as a recorder and a processor, as long as such other apparatus have a function for localizing a sound signal. Furthermore, the inventive sound processing apparatus 100 may be implemented by a dedicated hardware apparatus (integrated circuitry etc.) configured to perform the functions of the individual devices 10, 11, 12, 13, and 14 illustrated in FIG. 1. Further, the inventive sound processing apparatus 100 may be implemented by a processor apparatus having a function for executing a program to perform the functions of the individual devices 10, 11, 12, 13, and 14 illustrated in FIG. 1. For example, the inventive sound processing apparatus 100 is applicable to a DAW (Digital Audio Workstation) software application executed on a personal computer and to a video editing software application.

The embodiments of the present invention based on the above-described control performed by the CPU 21 may be understood as a method for adjusting the first parameter and second parameter to be used in the signal processing device (10). In such a case, the signal processing device (10) is configured to individually perform the first localization setting (sound volume panning) for setting localization of an input sound signal based on a value of the first parameter and the second localization setting (delay panning) for setting localization of the input sound signal based on a value of the second parameter different from the first parameter. This inventive method includes: adjusting the value of the first parameter or second parameter (S2, S4; S11, S15); in response to the adjustment of the value of one of the first parameter and second parameter, automatically changing the value of the other of the first parameter and second parameter (S3, S5; S12, S16); and outputting at least one of the sound signal localized in accordance with the first localization setting and the sound signal localized in accordance with the second localization setting (S8; S13, S14). Further, the embodiments of the present invention may be understood as a program for causing a processor (CPU 21) to perform the individual steps constituting the aforementioned method, or as a computer-readable, non-transitory storage medium storing such a program.

The foregoing disclosure has been set forth merely to illustrate the embodiments of the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A sound processing apparatus comprising:

a signal processing device configured to individually perform first localization setting for setting localization of an input sound signal based on a value of a first parameter and second localization setting for setting localization of the input sound signal based on a value of a second parameter different from the first parameter;

an operation device operable by a user for adjusting the value of the first parameter or the second parameter;

a control device that, in response to an adjustment by the operation device of the value of one of the first parameter and the second parameter, automatically changes the value of other of the first parameter and the second parameter; and an output device that outputs at least one of the sound signal localized in accordance with the first localization setting and the sound signal localized in accordance with the second localization setting, wherein in accordance with the value of one of the first parameter and the second parameter adjusted via the operation device, the control device automatically changes the value of the other of the first parameter and the second parameter according to a criterion prescribing association between the value of the first parameter and the value of the second parameter.

2. The sound processing apparatus as claimed in claim 1, further comprising a selector that selects one of the sound signal localized in accordance with the first localization setting and the sound signal localized in accordance with the second localization setting, and wherein the output device outputs the sound signal selected by the selector.

3. The sound processing apparatus as claimed in claim 1, wherein the output device outputs each of the sound signal localized in accordance with the first localization setting and the sound signal localized in accordance with the second localization setting.

4. The sound processing apparatus as claimed in claim 1, wherein the criterion prescribes the association between the value of the first parameter and the value of the second parameter such that the localization of the sound signal set in accordance with the first localization setting and the localization of the sound signal set in accordance with the second localization setting become same as each other.

5. The sound processing apparatus as claimed in claim 1, wherein the criterion prescribes the association between the value of the first parameter and the value of the second parameter in accordance with respective environments of an output destination of the sound signal localized in accordance with the first localization setting and an output destination of the sound signal localized in accordance with the second localization setting.

6. The sound processing apparatus as claimed in claim 1, wherein the criterion is set by the user.

7. The sound processing apparatus as claimed in claim 1, wherein the criterion associates the value of the first parameter and the value of the second parameter with each other in a stepwise manner.

8. The sound processing apparatus as claimed in claim 1, wherein the control device has a table storing the criteria prescribing the association.

9. A sound processing apparatus comprising:

a signal processing device configured to individually perform first localization setting for setting localization of an input sound signal based on a value of a first parameter and a second localization setting for setting localization of the input sound signal based on a value of a second parameter different from the first parameter;

an operation device operable by a user for adjusting the value of the first parameter or the second parameter;

a control device that, in response to an adjustment by the operation device of the value of one of the first parameter and the second parameter, automatically changes the value of other of the first parameter and the second parameter; and an output device that outputs at least one of the sound signal localized in accordance with the first localization setting and the sound signal localized in accordance with the second localization setting, wherein the first parameter is a parameter for setting localization based on a sound volume difference between a plurality of channels, and the second parameter is a parameter for setting localization based on a signal delay time difference between the plurality of channels.

10. The sound processing apparatus as claimed in claim 9, wherein the change by the control device comprises automatically changing, in accordance with the value of the one of the first parameter and the second parameter, the value of the other of the first parameter and the second parameter, based on characteristics of a sound volume difference and a time difference in localized sound signal between two ears of a listener.

11. A method for adjusting a first parameter and a second parameter to be used in a signal processing device, the signal processing device being configured to individually perform first localization setting for setting localization of an input sound signal based on a value of the first parameter and second localization setting for setting localization of the input sound signal based on a value of the second parameter different from the first parameter, the method comprising:

adjusting the value of the first parameter or the second parameter;

in response to an adjustment of the value of one of the first parameter and the second parameter, automatically changing the value of other of the first parameter and the second parameter; and outputting at least one of the sound signal localized in accordance with the first localization setting and the sound signal localized in accordance with the second localization setting, wherein in response to the adjustment of the value of one of the first parameter and the second parameter, the value of the other of the first parameter and the second parameter is automatically changed in such a manner that, in accordance with the value of one of the first parameter and the second parameter adjusted by the adjustment, the value of the other of the first parameter and the second parameter is automatically changed according to a criterion prescribing association between the value of the first parameter and the value of the second parameter.

12. The method as claimed in claim 11, further comprising selecting one of the sound signal localized in accordance with the first localization setting and the sound signal localized in accordance with the second localization setting, wherein the selected one of the sound signal localized in accordance with the first localization setting and the sound signal localized in accordance with the second localization setting is output.

13. The method as claimed in claim 11, wherein each of the sound signal localized in accordance with the first localization setting and the sound signal localized in accordance with the second localization setting is output.

14. The method as claimed in claim 11, wherein the value of the other of the first parameter and the second parameter is automatically changed based on a table storing the criterion.

15. A method for adjusting a first parameter and a second parameter to be used in a signal processing device, the signal processing device being configured to individually perform first localization setting for setting localization of an input sound signal based on a value of the first parameter and second localization setting for setting localization of the input sound signal based on a value of the second parameter different from the first parameter, the method comprising:

adjusting the value of the first parameter or the second parameter;

in response to an adjustment of the value of one of the first parameter and the second parameter, automatically changing the value of the other of the first parameter and the second parameter; and outputting at least one of the sound signal localized in accordance with the first localization setting and the sound signal localized in accordance with the second localization setting, wherein the first parameter is a parameter for setting localization based on a sound volume difference between a plurality of channels, and the second parameter is a parameter for setting localization based on a signal delay time difference between the plurality of channels.

16. A computer-readable, non-transitory storage medium storing a group of instructions executable by a processor for performing a method for adjusting a first parameter and a second parameter to be used in a signal processing device, the signal processing device being configured to individually perform first localization setting for setting localization of an input sound signal based on a value of the first parameter and second localization setting for setting localization of the input sound signal based on a value of the second parameter different from the first parameter, the method comprising:

adjusting the value of the first parameter or the second parameter;

in response to an adjustment of the value of one of the first parameter and the second parameter, automatically changing the value of other of the first parameter and the second parameter; and outputting at least one of the sound signal localized in accordance with the first localization setting and the sound signal localized in accordance with the second localization setting, wherein in response to the adjustment of the value of one of the first parameter and the second parameter, the value of the other of the first parameter and the second parameter is automatically changed in such a manner that, in accordance with the value of one of the first parameter and the second parameter adjusted by the adjustment, the value of the other of the first parameter and the second parameter is automatically changed according to a criterion prescribing association between the value of the first parameter and the value of the second parameter.

* * * * *